US005704547A

United States Patent [19]

Golan et al.

[11] Patent Number: 5,704,547

[45] Date of Patent: Jan. 6, 1998

[54] PERIODIC MOTION SHOWER HEAD

[76] Inventors: Zeev Golan, 9 Stern Street, 46412 Herzliya; Dov Sheffer, 3 Petah Tikva Street, 58337 Holon, both of Israel

[21] Appl. No.: 398,384

[22] Filed: Mar. 3, 1995

[30] Foreign Application Priority Data

Mar. 6, 1994 [IL] Israel ..... 108866

[51] Int. Cl.[6] ..... B05B 3/04

[52] U.S. Cl. ..... 239/11; 239/240; 239/227

[58] Field of Search ..... 239/240, 242, 239/227, 473, 1.11

[56] References Cited

U.S. PATENT DOCUMENTS

| | | | |
|---|---|---|---|
| 928,386 | 7/1909 | Johnson | 239/227 |
| 1,156,612 | 10/1915 | Morrell | 239/227 |
| 1,958,038 | 5/1934 | Fraser | 239/596 X |
| 2,681,250 | 6/1954 | Metcalf | 239/227 |
| 2,691,549 | 10/1954 | Hayward | 239/242 X |
| 3,595,256 | 7/1971 | Waltman | 239/227 X |
| 3,601,136 | 8/1971 | Marcham | 134/167 R |
| 3,875,604 | 4/1975 | Wurn | 15/21 |
| 3,902,670 | 9/1975 | Koller et al. | 239/227 |
| 4,274,400 | 6/1981 | Baus | 128/53 |
| 4,662,768 | 5/1987 | Gottwald et al. | 239/588 X |
| 4,944,457 | 7/1990 | Brewer | 239/242 |
| 5,148,991 | 9/1992 | Kah | 239/242 |
| 5,201,468 | 4/1993 | Freier et al. | 239/383 |
| 5,294,054 | 3/1994 | Benedict et al. . | |

FOREIGN PATENT DOCUMENTS

| | | |
|---|---|---|
| 2658435 | 8/1991 | France . |
| 3044260 | 6/1982 | Germany . |
| 3245756 | 6/1984 | Germany . |
| 1316704 | 6/1987 | U.S.S.R. . |

*Primary Examiner*—Kevin Weldon
*Attorney, Agent, or Firm*—Ladas & Parry

[57] ABSTRACT

A shower head including a housing, a turbine and a fluid exit body in operative engagement therewith, such that a fluid flow through the turbine causes rotation thereof and periodic motion of the fluid exit body. The fluid exit body is in a tilted position in the housing and the periodic motion consists of a simultaneous rotational travel of the fluid exit body around the axis of the turbine and an oscillatory, rocking movement of the fluid exit body in the housing.

27 Claims, 10 Drawing Sheets

PERIODIC MOTION SHOWER HEAD

FIELD OF THE INVENTION

The present invention relates to shower and/or bathing apparatus generally.

BACKGROUND OF THE INVENTION

In general, most spray assemblies of showers and baths which are in current use operate under the principle that each flow of water which exits an exit hole of the spray assembly is aimed at only one area on the body of the user.

A disadvantage of this type of spray assembly is that only a relatively limited area of the body is bathed at one time. Another disadvantage is that the user feels a stream of water continuously on the same area. If a massage, or pulsating, type of shower apparatus is used, the user senses that the flow of water is "drilling" into his body, thus diminishing the pleasure derived from use of such apparatus.

In addition, it is well known in the art that movement of water on a bather sitting in a bath tub enhances the pleasure of bathing. However, mechanisms which create such movement generally are expensive and comprise a relatively large amount of parts.

SUMMARY OF THE INVENTION

The present invention seeks to provide apparatus and a method for washing the body by passing water over the body in a slow, periodical manner resembling caressing. The method and apparatus are also applicable for any delivery of fluid in a periodical manner.

In the case of showering or bathing, the water slowly changes position on the user's body and causes a caressing feeling, thereby causing a pleasurable feeling. When used in conjunction with a massage type of shower head, there is no "drilling" feeling on the body. Larger areas of the body are bathed by the invention than prior art shower apparatus.

There is thus provided in accordance with a preferred embodiment of the present invention, a shower head including a housing, a turbine and a fluid exit body in operative engagement therewith, such that a fluid flow through the turbine causes rotation thereof and periodic motion of the fluid exit body.

The fluid exit body preferably includes a spray head, massage head, or combination of both.

Additionally in accordance with a preferred embodiment of the present invention, the turbine has an adjustable aperture such that a quantity of the fluid flow through the turbine is controllable by adjusting the adjustable aperture, thereby permitting control of speed of the periodic motion of the fluid exit body.

Further in accordance with a preferred embodiment of the present invention, the fluid exit body is operative to move periodically in a generally rotational motion about a first axis and a second axis simultaneously.

Preferably, the first axis includes a central axis of the shower head and the second axis includes a central axis of the fluid exit body, the central axis of the fluid exit body being tilted or displaced with respect to the central axis of the shower head.

In accordance with a preferred embodiment of the present invention, a drive element is situated eccentrically with respect to a central axis of the turbine and operative to transfer rotation of the turbine into periodic motion of the fluid exit body.

Additionally in accordance with a preferred embodiment of the present invention, the shower head further includes gear apparatus in rotatable engagement with the turbine and the fluid exit body, the gear apparatus operable to reduce rotational speed of the fluid exit body with respect to rotational speed of the turbine.

Additionally in accordance with a preferred embodiment of the present invention, the fluid exit body has a plurality of holes eccentrically located with respect to a central axis of the shower head.

Further in accordance with a preferred embodiment of the present invention, the fluid exit body has a plurality of holes having different diameters.

Additionally in accordance with a preferred embodiment of the present invention, the turbine includes a first blade assembly, including at least one blade and an exit port, and a second blade assembly, including at least one blade and an inlet port, such that the inlet port and the exit port may be aligned with each other upon suitable rotation of the first and the second blade assemblies with respect to each other, and wherein the flow of fluid impinges upon the first blade assembly and causes rotation thereof, and wherein the flow of fluid impinges upon the second blade assembly and causes rotation thereof only when the inlet and the exit ports are aligned with each other.

In accordance with a preferred embodiment of the present invention, the shower head also includes a braking device operable to substantially stop the periodic motion of the fluid exit body.

Further in accordance with a preferred embodiment of the present invention, the shower head further includes attachment apparatus for assembly of a plurality of the shower heads, the attachment apparatus including a plurality of tubes, at least one of the tubes being adjustable in length.

Additionally in accordance with a preferred embodiment of the present invention, apparatus further includes an elongate tube including at least one fluid exit body, the turbine being operative to rotate the fluid exit body alternatively clockwise and counterclockwise about a central axis of the elongate tube.

Additionally in accordance with a preferred embodiment of the present invention, the fluid exit body is at least partially submerged in a fluid and is operative to move periodically, thereby creating waves in the fluid.

Preferably the turbine includes at least one plate attached to a hinge, wherein rotation of the turbine causes an oscillation of the at least one plate, thereby creating waves in the fluid.

There is also provided in accordance with a preferred embodiment of the present invention, a method for applying fluid on a user's body by using a shower head including a housing, a turbine and a fluid exit body, the fluid exit body including a face having a plurality of holes, wherein the fluid causes the turbine to rotate and the turbine causes the fluid exit body to move in a periodic motion such that the face changes its position spatially during the periodic motion.

Additionally in accordance with a preferred embodiment of the present invention, the method includes controlling a quantity of the fluid flow through the turbine by an adjustable aperture, thereby controlling speed of the periodic motion of the fluid exit body.

Further in accordance with a preferred embodiment of the present invention, the fluid is caused to exit the fluid exit body by a periodic motion including rotational motion about a first axis and a second axis simultaneously, so as to cause the face to change its spatial position during the periodic motion.

Additionally in accordance with a preferred embodiment of the present invention, the first axis includes a central axis of the shower head and the second axis includes a central axis of the fluid exit body, the central axis of the fluid exit body being tilted or displaced with respect to the central axis of the shower head.

Further in accordance with a preferred embodiment of the present invention, the method includes transferring rotation of the turbine into periodic motion of the fluid exit body through a drive element situated eccentrically with respect to a central axis of the turbine.

Additionally in accordance with a preferred embodiment of the present invention, the method includes rotating the fluid exit body by rotating the turbine, the turbine being attached to the fluid exit body via gear apparatus operable to reduce rotational speed of the fluid exit body with respect to rotational speed of the turbine.

Further in accordance with a preferred embodiment of the present invention, the turbine includes a first blade assembly, including at least one blade and an exit port, and a second blade assembly, including at least one blade and an inlet port, and the method includes the step of flowing fluid such that the flow of fluid impinges upon the first blade assembly thereby to cause rotation thereof, and the flow of fluid impinges upon the second blade assembly thereby to cause rotation thereof only when the inlet and the exit ports are aligned with each other.

Further in accordance with a preferred embodiment of the present invention, the method includes using a plurality of the shower heads to cause a periodic flow of fluid.

Additionally in accordance with a preferred embodiment of the present invention, the turbine is at least partially submerged in a fluid and moves periodically therein, thereby creating waves in the fluid.

Preferably the turbine includes at least one plate attached to a hinge, wherein rotating the turbine causes an oscillation of the at least one plate, thereby creating waves in the fluid.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
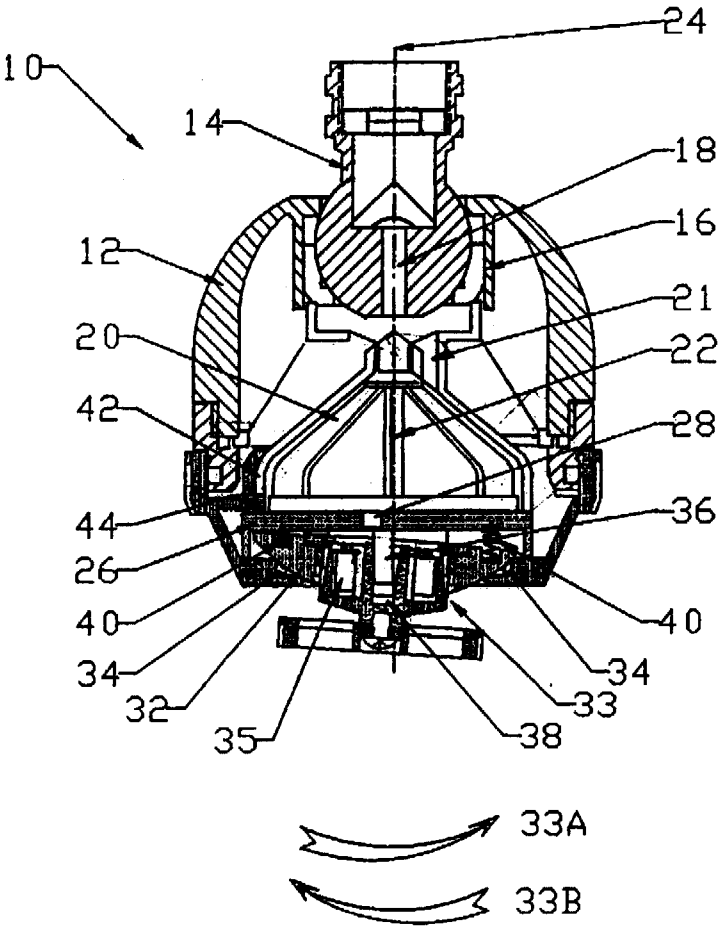
FIG. 1 is a partial sectional illustration of a shower head constructed and operative in accordance with a preferred embodiment of the present invention, during one portion of an operating cycle.

Reference is made to FIG. 1 which illustrates a shower head 10 constructed and operative in accordance with a preferred embodiment of the present invention. The shower head 10 preferably comprises a housing 12 and inlet apparatus 14 pivotally mounted therein preferably by means of a generally hemispherically shaped pivot seal 16. Inlet apparatus 14 is attachable to a supply of fluid (not shown) and preferably comprises an inlet 18 for inlet of a fluid flow.

Shower head 10 comprises a turbine 20 located downstream of the inlet 18. The turbine 20 is in fluid communication with the inlet 18 preferably via an opening 21. A central axis 22 of the turbine is substantially colinear with a central axis 24 of the shower head 10. A sliding element 26 is in operative engagement with the turbine 20 preferably by means of a drive element 28 located eccentrically with respect to the axis 22.

The sliding element 26 engages with a fluid exit body 32 by means of a post 36 which is slidably attached at one end thereof to the sliding element 26. An opposite end of the post 36 is preferably generally spherical in shape, and engages with a socket 38 in the fluid exit body 32. The fluid exit body 32 is preferably biased against the underside of the sliding element 26 by means of biasing devices 40, such as springs.

The eccentrically located drive element 28 together with the sliding element 26 and the post 36 form a mechanism for converting rotary motion to oscillatory motion. The eccentrically located drive element 28 is operative to rotate about the axis 22 and the sliding element 26 provides sliding linkage to the post 36 such that the rotary motion of the drive element 28 is converted to periodic motions of the post 36 and the fluid exit body 32 from the left to the right and vice versa, as indicated by arrows 33A and 33B in FIG. 1.

The fluid exit body 32 is preferably pivotally mounted in a tilted position in the housing 12 by means of a generally hemispherically shaped pivot seal 34. The fluid exit body 32 may comprise a spray head or massage head or a combination thereof, or any other type or combination of shower head used in the art. As an example only, the shower head 10 is illustrated in FIG. 1 with a conventional massage rotor 35.

In a preferred embodiment of the present invention, the turbine 20 is provided with an adjustable aperture 42, preferably shaped as a slot along a portion of the periphery of the turbine 20. Preferably a ring 44 is slidably attached to the periphery of the housing 12 and is operable to selectably cover or open aperture 42.

The operation of the shower head 10 is now described with reference to FIGS. 1 and 2. Fluid, generally water or any other suitable fluid, enters inlet apparatus 14, passes through the inlet 18 and flows via opening 21 into the turbine 20, causing rotation thereof.

Figure 2:
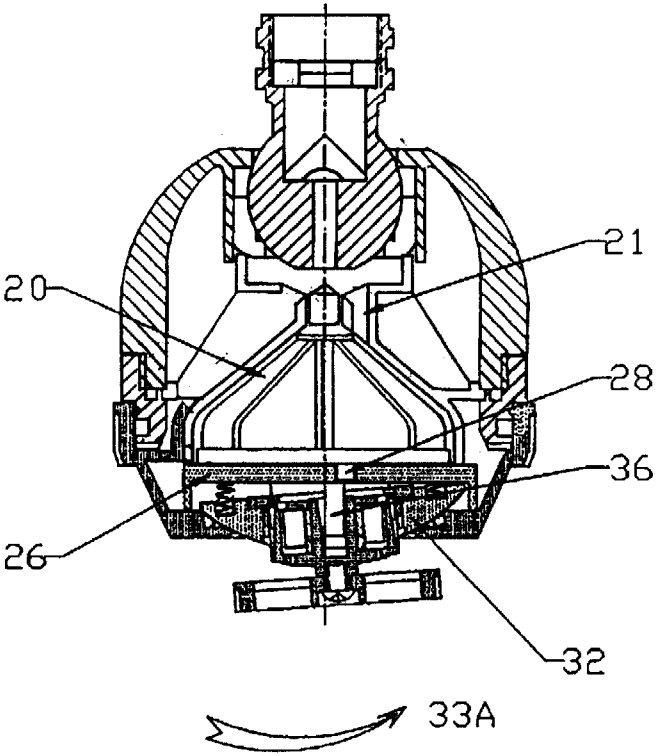
FIG. 2 is a partial sectional illustration of the shower head of FIG. 1 during another portion of the operating cycle.

As the turbine 20 rotates, the drive element 28 eccentrically rotates about the central axis 22 of the turbine 20, thereby pushing the sliding element 26 towards the right as viewed in the sense of FIG. 1, towards the position shown in FIG. 2.

Since the post 36 is engaged with the sliding element 26 at one end thereof and with the fluid exit body 32 at an opposite end thereof, the post 36 is pushed towards the right as viewed in the sense of FIG. 1 by the sliding element 26. The post 36 in turn causes the fluid exit body 32 to rock in the direction of arrow 33A.

Continued rotation of the turbine 20 causes the drive element 28 to continue to eccentrically rotate about the central axis 22 of the turbine 20, thereby pushing the sliding element 26 and the post 36 towards the left, that is, from the position illustrated in FIG. 2 to return to the position illustrated in FIG. 1. The return motion of the post 36 causes the fluid exit body 32 to rock in the direction of arrow 33B. Consequently, the fluid exit body undergoes two simultaneous movements, one an orbital travel around axis and the other an oscillating rocking movement on its hemispherical support in housing 12.

As the fluid exit body 32 rotates, the fluid flow exits the fluid exit body 32 either as a spray, massage or combination thereof. Thus the fluid flow exits the fluid exit body 32 in a pendulum like manner, the flow oscillating between the positions illustrated in FIGS. 1 and 2.

A user may adjust the oscillation of the fluid exit body 32 by turning the ring 44 to adjust the size of the aperture 42. The smaller the aperture 42, the greater the resistance to rotation of the turbine 20, thereby decreasing the oscillation of flow. Experience has shown that generally users prefer a period of oscillation in the range of one half to five seconds per cycle.

Figure 3A:
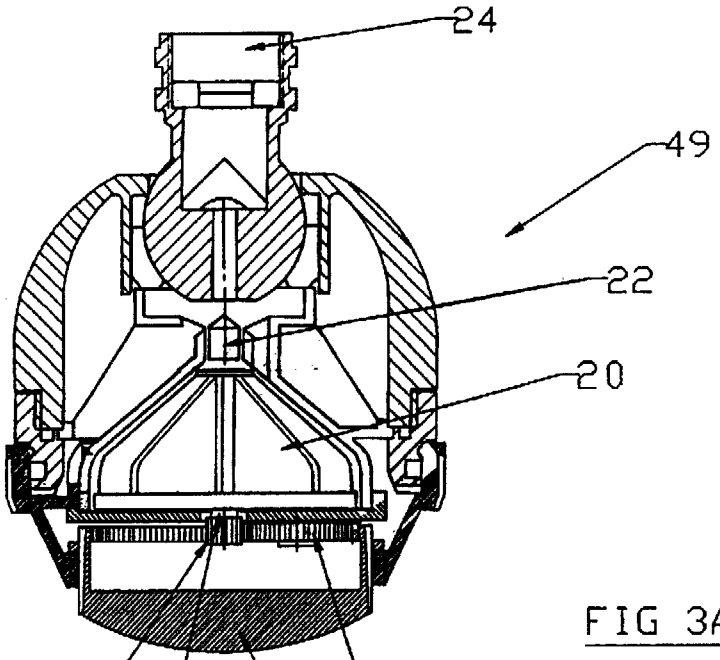
FIG. 3A is a partial sectional illustration of a shower head constructed and operative in accordance with another preferred embodiment of the present invention.
Figure 3B:
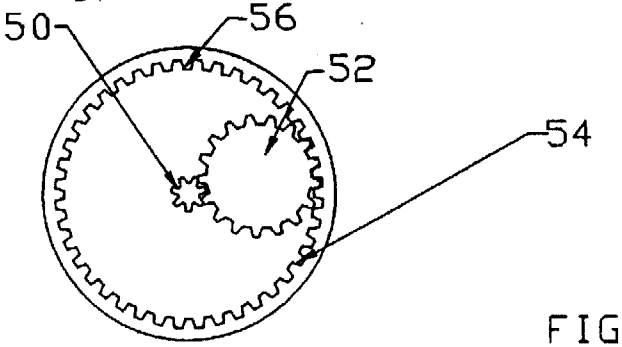
FIG. 3B is an illustration of gear apparatus useful in the shower head of FIG. 3A, as viewed in the direction of arrow 3B in FIG. 3A.

Reference is now made to FIGS. 3A and 3B which illustrate a shower head 49 constructed and operative in accordance with another preferred embodiment of the present invention, and in which like numerals label similar elements of the previous embodiment illustrated in FIGS. 1 and 2. The shower head 49 is similar in construction to the shower head 10 described hereinabove. However, in this embodiment, the turbine 20 preferably comprises a spur gear 50 which rotates about the axis 22 and which meshes with a gear 52. The gear 52 meshes with internal teeth 54 of a fluid exit body 56. The fluid exit body 56 rotates about a central axis 57 thereof.

In operation of the shower head 49, fluid passes through the opening 21 and enters the turbine 20, causing rotation thereof. As the turbine 20 rotates, the spur gear 50 rotates therewith, causing rotation of gear 52, thereby causing rotation of the toothed fluid exit body 56. Thus fluid exits the fluid exit body 56 in a rotational manner.

Preferably the gears 50 and 52, as well as the toothed fluid exit body 56, are sized such that the rotational speed of the fluid exit body 56 is reduced with respect to the rotational speed of the turbine 20.

As described hereinabove for the fluid exit body 32, the fluid exit body 56 may comprise a spray head, massage head or combination thereof, or any other type or combination of head used in the art.

Figure 4:
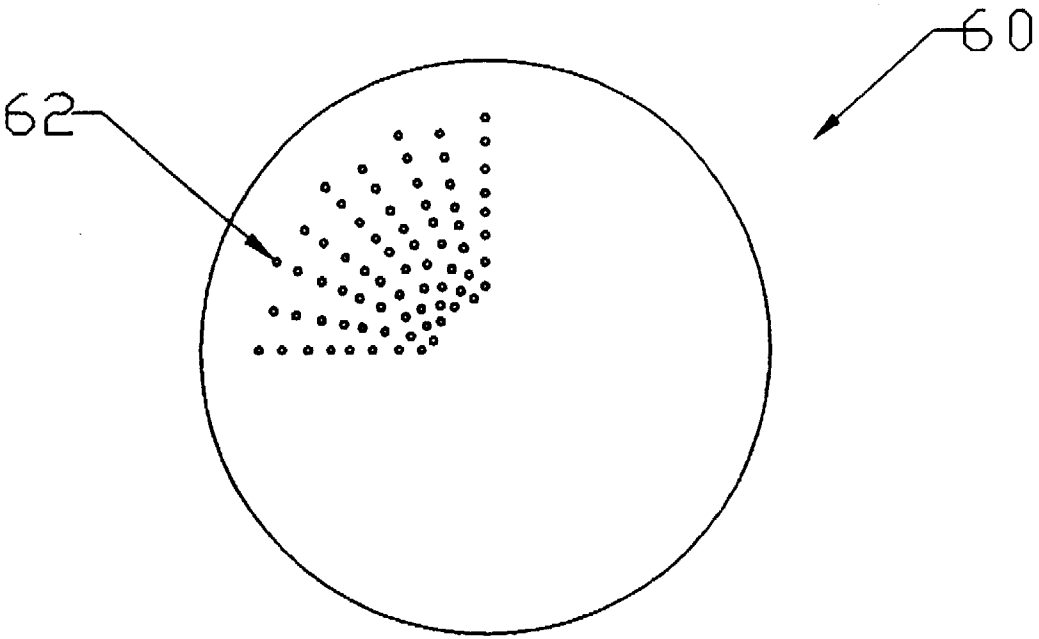
FIG. 4 is a simplified illustration of a front view of a fluid exit body which may be used with either of the embodiments illustrated in FIGS. 1–3B.

Reference is now made to FIG. 4 which illustrates a fluid exit body 60 which may be used with either of the embodiments illustrated and described hereinabove with reference to FIGS. 1–3B. The fluid exit body 60 has a plurality of holed 62 eccentrically located. As the fluid exit body 60 rotates, the fluid exiting the fluid exit body traverses a greeter circumference during its rotational motion.

Alternatively, the holes 62 may be centrally located and have different diameters. Alternatively, the holes 62 may be eccentrically located and have different diameters.

It is appreciated by persons skilled in the art that shower apparatus may be constructed in accordance with the present invention which comprises a combination of the embodiments shown in FIGS. 1 and 2 and FIGS. 3A and 3B. Such a shower head combines the oscillation and the rotation of the fluid flow.

Figure 5:
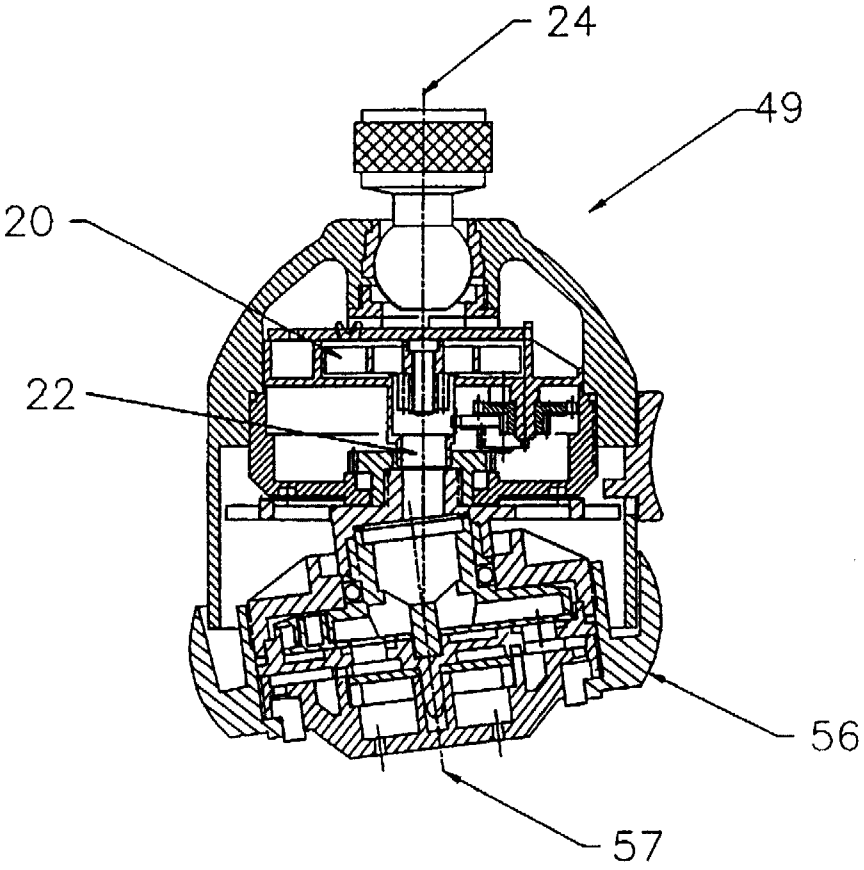
FIGS. 5, 6, 7, 8 and 9 are partial sectional illustrations of other shower heads constructed and operative in accordance with other preferred embodiments of the present invention.

Reference is now made to FIG. 5 which illustrates a shower head constructed and operative in accordance with a preferred embodiment of the present invention and substantially identical with the embodiment described with reference to FIGS. 3A–3B. However, in this embodiment, the central axis 57 of the fluid exit body 56 is angled or tilted with respect to the central axis 24 of the shower head 49. As the turbine 20 rotates, it causes the fluid exit body 56 to rotate by means of gear apparatus, as described hereinabove. Thus the fluid exiting the fluid exit body 56 traverses a greater circumference during its rotational motion. The fluid exit body 56 moves periodically in a generally rotational motion about the central axis 22 of the turbine 20 and simultaneously its central axis 57 undergoes an oscillating, rocking movement.

Figure 6:
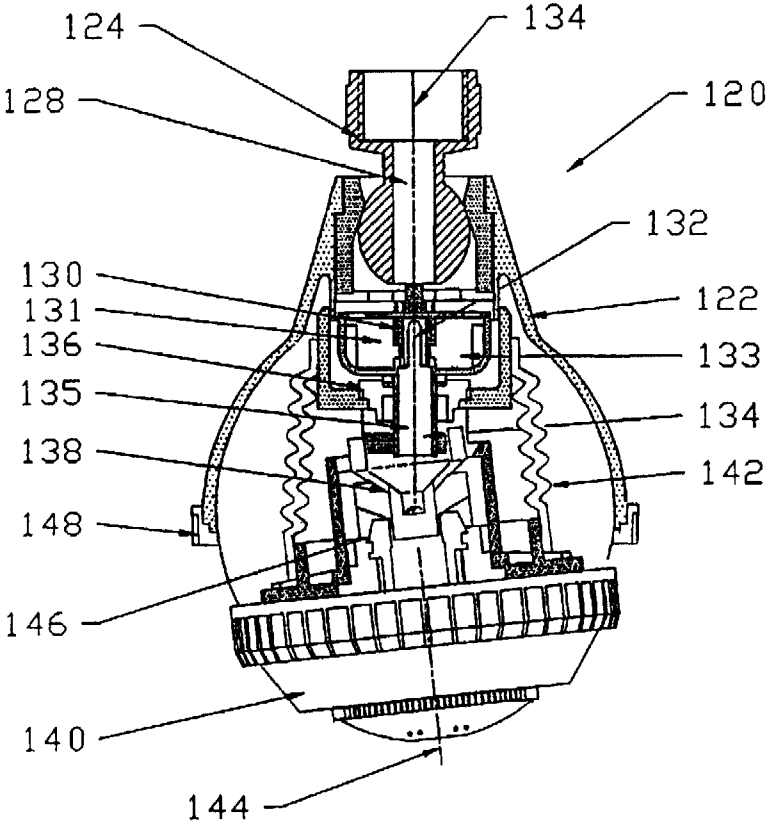

Reference is now made to FIG. 6 which illustrates a shower head 120 constructed and operative in accordance with another preferred embodiment of the present invention. The shower head 120 preferably comprises a housing 122 and inlet apparatus 124 pivotally mounted therein. Inlet apparatus 124 is attachable to a supply of fluid (not shown) and preferably comprises an inlet 128 for inlet of a fluid flow.

Shower head 120 comprises a turbine 130 located downstream of the inlet 128 and in fluid communication therewith. A central axis 132 of the turbine is substantially colinear with a central axis 134 of the shower head 120.

The turbine 130 comprises a blade assembly 131 which comprises at least one blade 133. The turbine 130 further comprises a shaft 135 at one end of which is attached a cam 136.

The cam 136 is in operable engagement with a funnel 138. The funnel 138 is attached to a fluid exit body 140 which is preferably sealably attached to the housing 122, preferably by a flexible bellows seal 142. The fluid exit body 140 is operative to precess about the axis 132.

A central axis 144 of the fluid exit body 140 may be oriented at an angle with respect to the axis 132 by tilting the fluid exit body 140 about a generally spherical pivot ball 146 located at a base of the funnel 138. The fluid exit body 140 and the housing 122 are configured such that the fluid exit body 140 is substantially fixed at the chosen angle.

Preferably a stopper 148 is provided on the housing 122. The stopper 148 may be lowered or raised in the sense of FIG. 6, thereby adjusting the limits of oscillation of the fluid exit body 140.

The fluid exit body 140 may comprise a spray head or massage head or a combination thereof, or any other type or combination of shower head used in the art.

In operation of the shower head 120, fluid enters the blade assembly 131 via the inlet 128, thereby causing rotation of the turbine 130, the shaft 135 and the cam 136. As the cam 136 rotates, it pushes therewith the funnel 138, thereby causing the fluid exit body 140 to simultaneously rotate about the axis 132 and undergo rocking movement around pivot ball 146.

Figure 7:
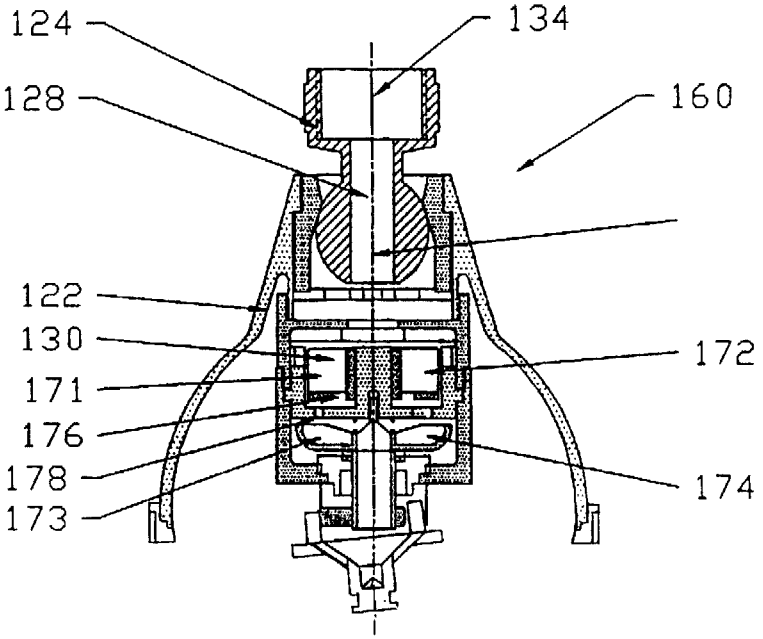

Reference is now made to FIG. 7 which is a partial illustration of a shower head 160 constructed and operative in accordance with another preferred embodiment of the present invention, and in which like numerals label similar elements of the previous embodiment illustrated in FIG. 6.

The shower head 160 is similar in construction to the shower head 120 described hereinabove. However, in this embodiment, the turbine 130 comprises a first blade assembly 171 which comprises at least one blade 172, and a second blade assembly 173 which comprises at least one blade 174. The first blade assembly 171 and the second blade assembly 173 rotate with respect to each other about the axis 132.

The first blade assembly 171 has an exit port 176 and the second blade assembly 173 has an inlet port 178. The exit port 176 and the inlet port 178 are arranged such that they may be aligned with each other upon suitable rotation of the first blade assembly 171 and the second blade assembly 173.

In operation, fluid enters the first blade assembly 171 and upon the at least one blade 172, thereby causing rotation of the first blade assembly 171. The fluid exits the first blade assembly 171 upon the exit port 176 being aligned with the inlet port 178. The fluid enters the second blade assembly 173 and impinges upon the at least one blade 174, thereby causing rotation of the second blade assembly 173.

There is thus a transmission of power in pulses from the first blade assembly 171 to the second blade assembly 173. The pulsed transmission of power helps to overcome any interference to fluid flow which may be encountered during operation, such as from grit.

Figure 8:
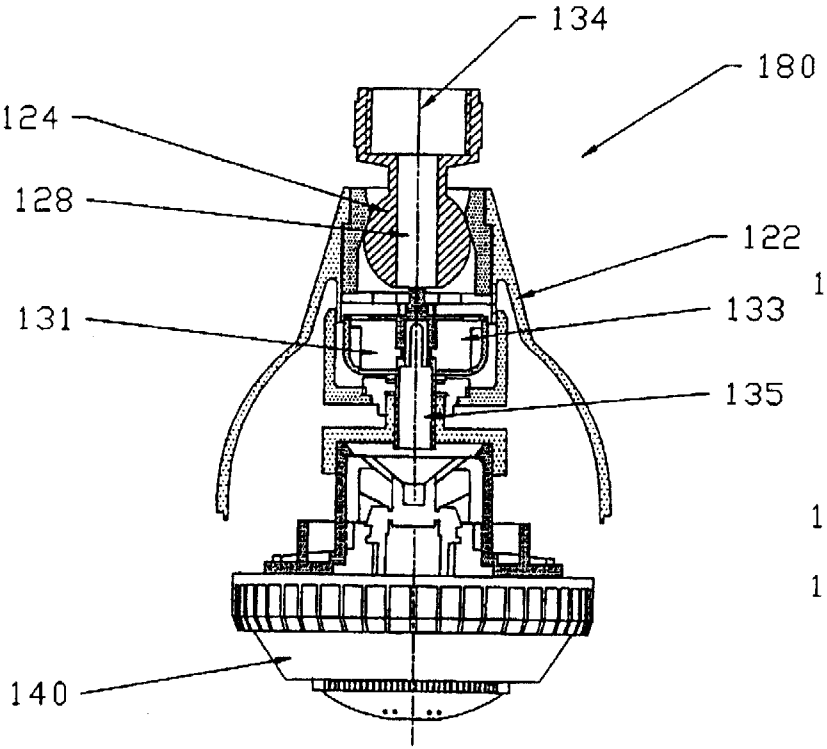

Reference is now made to FIG. 8 which is a simplified illustration of a shower head 180 constructed and operative in accordance with another preferred embodiment of the present invention, and in which like numerals label similar elements of the previous embodiment illustrated in FIG. 6.

The shower head 180 is similar in construction to the shower head 120 described hereinabove. However, in this embodiment, no cam 136 is present. Rotation of the turbine 130 causes rotation of the fluid exit body 140.

Figure 9:
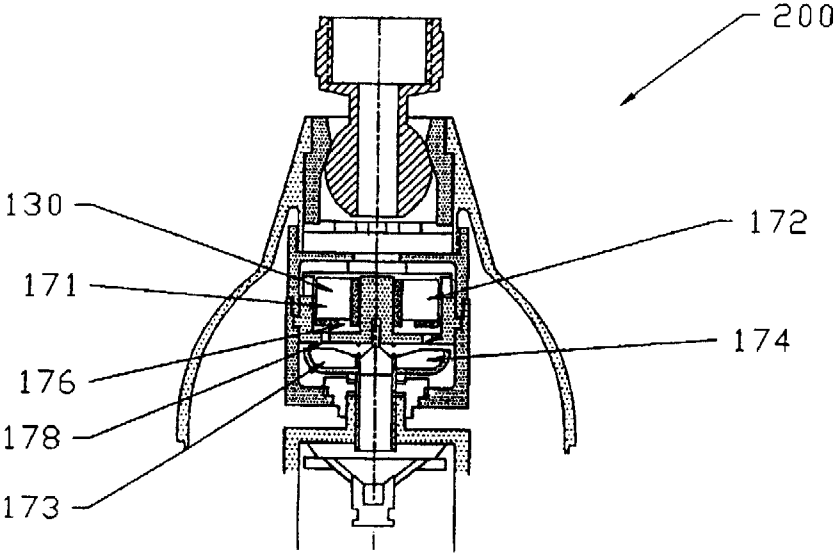

Reference is now made to FIG. 9 which is a simplified illustration of a shower head 200 constructed and operative in accordance with another preferred embodiment of the present invention, and in which like numerals label similar elements of the previous embodiments illustrated in FIGS. 7 and 8.

The shower head 200 is a hybrid version of the embodiments of FIGS. 7 and 8. In this embodiment of FIG. 9, the turbine 130 causes rotation of the fluid exit body 140 (not shown) by means of pulsed rotation of the second blade assembly 173 as described hereinabove with respect to FIG. 7.

Figure 10B:
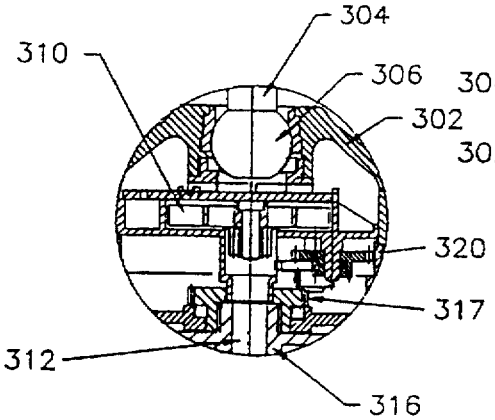
FIGS. 10B and 10C are sectional illustrations of portions of shower apparatus/shown in FIG. 11A, taken along lines 10B—10B and 10C—10C respectively in FIG. 10A.
Figure 10A:
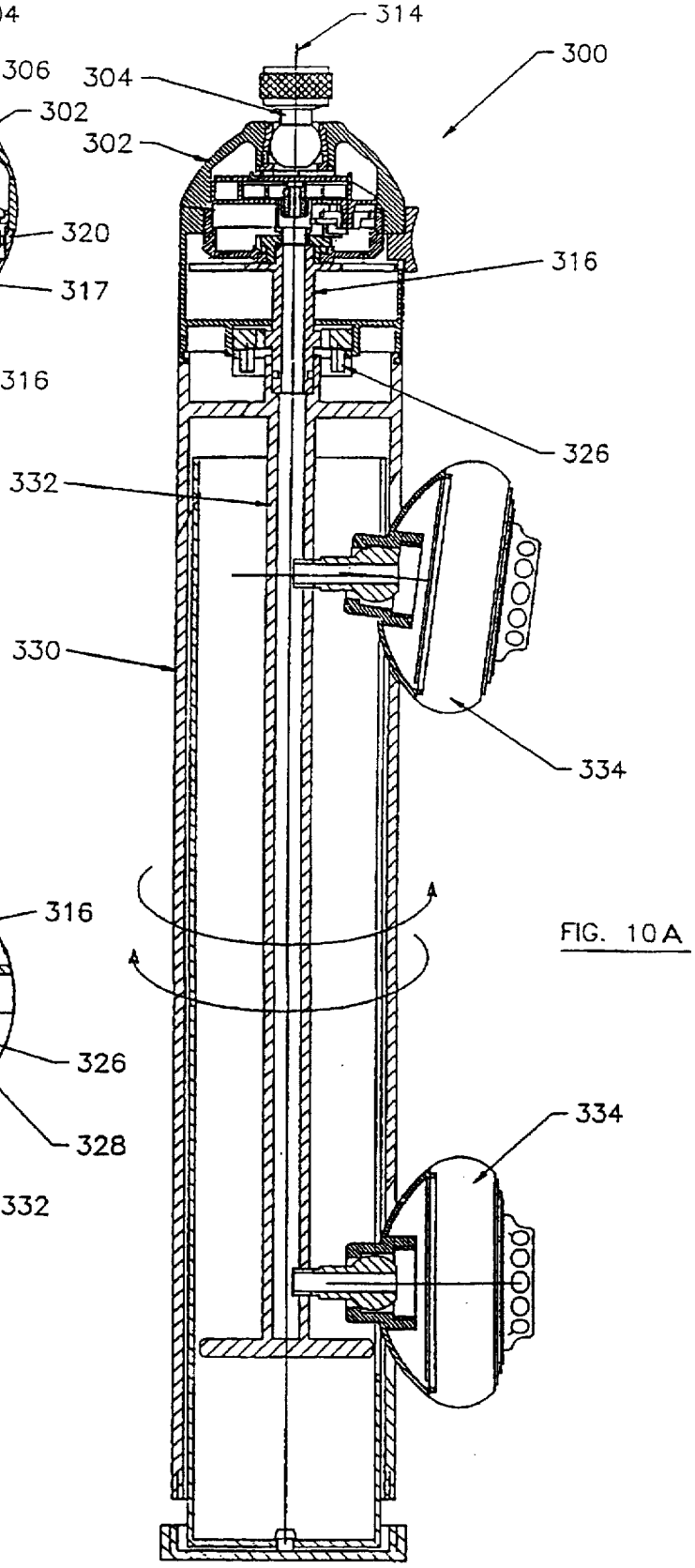
FIG. 10A is a partial sectional illustration of shower apparatus which includes an elongate tube which includes at least one fluid exit body, and the turbine is operative to rotate the fluid exit body alternatively clockwise and counterclockwise about a central axis of the tube.
Figure 10C:
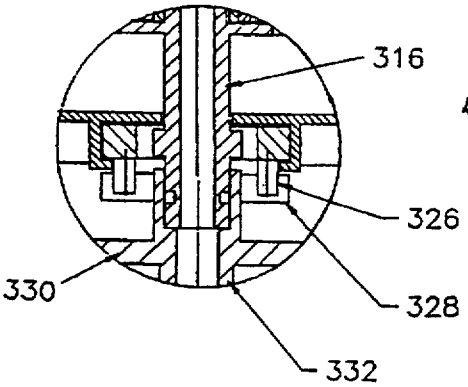

Reference is now made to FIGS. 10A–10C which illustrate shower apparatus 300 constructed and operative in accordance with another preferred embodiment of the present invention. Shower apparatus 300 preferably comprises a housing 302 and inlet apparatus 304 pivotally mounted therein. Inlet apparatus 304 is attachable to a supply of fluid (not shown) and preferably comprises an inlet 306 for inlet of a fluid flow.

As shown in FIG. 10B, shower apparatus 300 comprises a turbine 310 located downstream of the inlet 306 and in fluid communication therewith. A central axis 312 of the turbine is substantially colinear with a central axis 314 of shower apparatus 300.

The turbine 310 is operative to rotate a hollow shaft 316. As shown in FIG. 10B, the turbine 310 preferably rotates the shaft 316 by means of gear apparatus 320 attached to an output shaft 317 of the turbine 310. Gear apparatus 320 is operative to reduce the rotational speed of the shaft 316 and increase the torque of the turbine 310 used to rotate the shaft 316.

As shown in FIGS. 10A and 10C, the shaft 316 engages with a rotatable housing 330 by means of an eccentrically located pin 326 operatively engaged with a shoulder 328 of the housing 330.

As shown in FIGS. 10A and 10C, the housing 330 comprises an inner hollow shaft 332 which is in fluid communication with the shaft 316 of the turbine 310. The shaft 332 is in further fluid communication with one or more shower heads 334, such as but not necessarily, a shower head of any of the embodiments described hereinabove.

The rotation of the turbine 310 and the shaft 316 causes oscillatory motion of the rotatable housing 330 and shower heads 334 by means of the eccentrically located pin 326, in substantially the same manner as described hereinabove with respect to the embodiment of FIGS. 1 and 2.

As the housing 330 oscillates, fluid exits the shower heads 334 in an oscillatory motion. Combined oscillatory motion of shower heads 334 may be realized by using shower heads such as those of the present invention.

Figure 11:
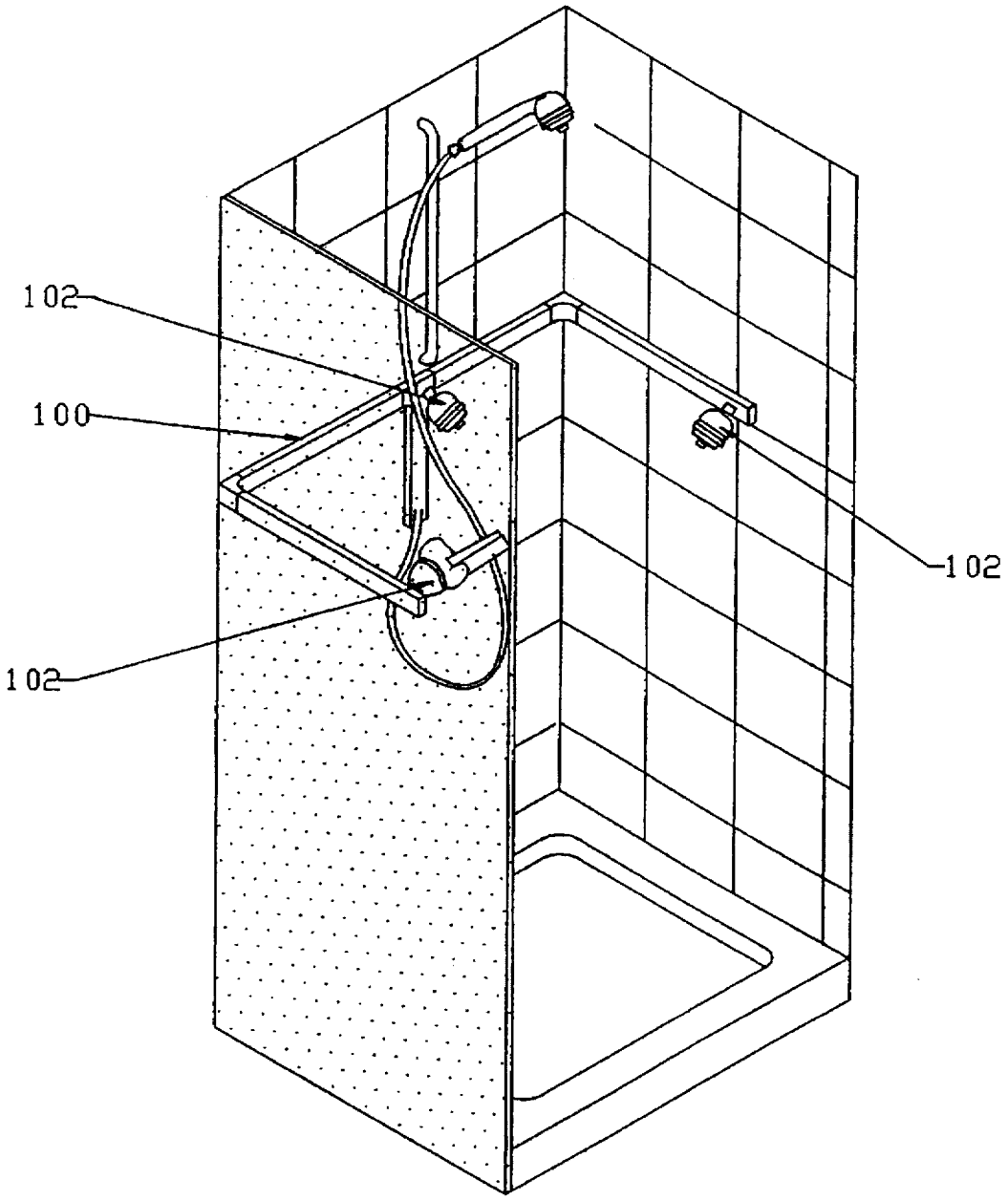
FIG. 11 is a simplified illustration of assembled shower apparatus including attachment apparatus for attachment thereof to a shower, constructed and operative in accordance with a preferred embodiment of the present invention.
Figure 12A:
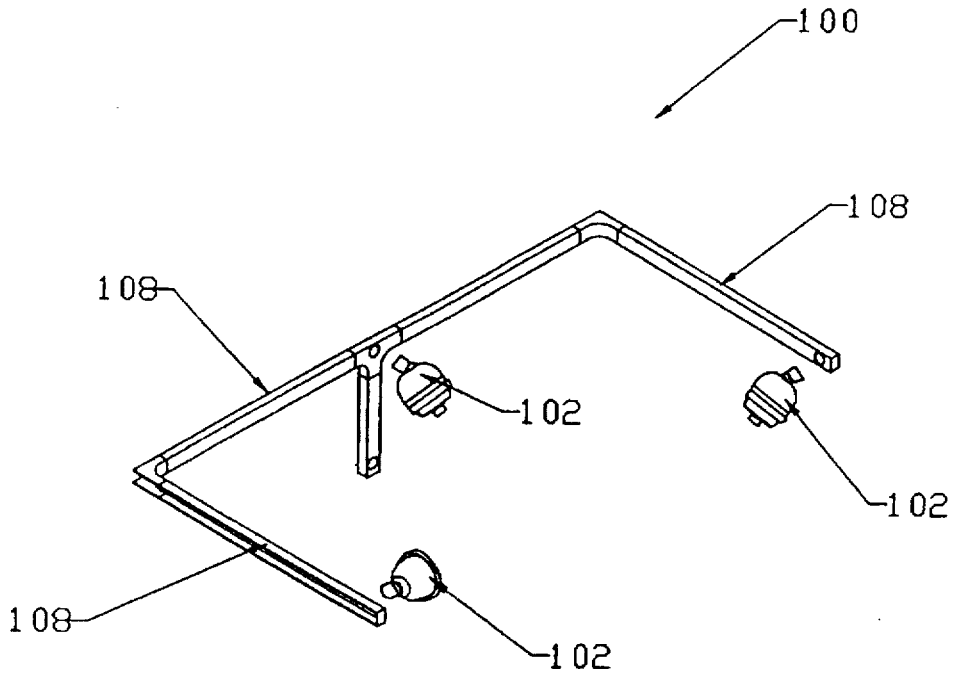
FIGS. 12A–12B are simplified, partially exploded illustrations of apparatus of FIG. 11 shown disassembled.
Figure 12B:
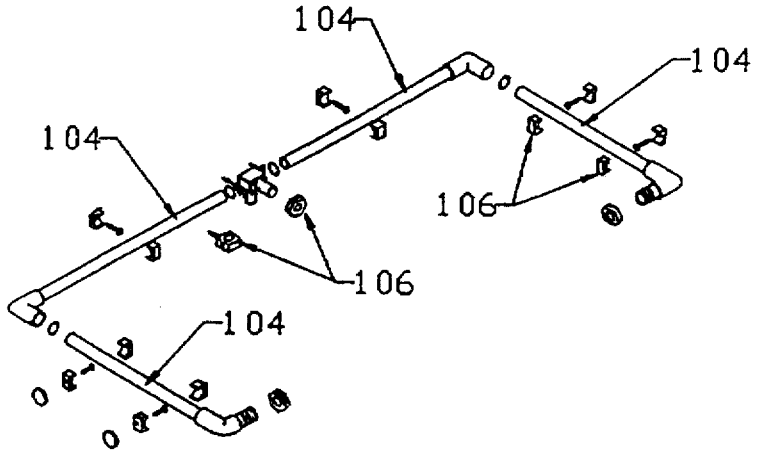

Reference is now made to FIGS. 11, 12A and 12B which illustrate attachment apparatus 100 for assembling a plurality of shower heads 102. As seen in FIG. 12B, attachment apparatus 100 preferably comprises a plurality of tubes 104 and suitable mounting accessories, generally designated by numeral 106.

As seen in FIG. 12A, attachment apparatus 100 also preferably comprises a plurality of decorative covers 108 for covering the plurality of tubes 104.

The tubes 104 may be suitably trimmed so that attachment apparatus 100 may be mounted in any shower. Alternatively, the tubes 104 may be adjustable in length, such as telescoping tubes or the like.

A completed assembly is shown in FIG. 11.

Figure 13A:
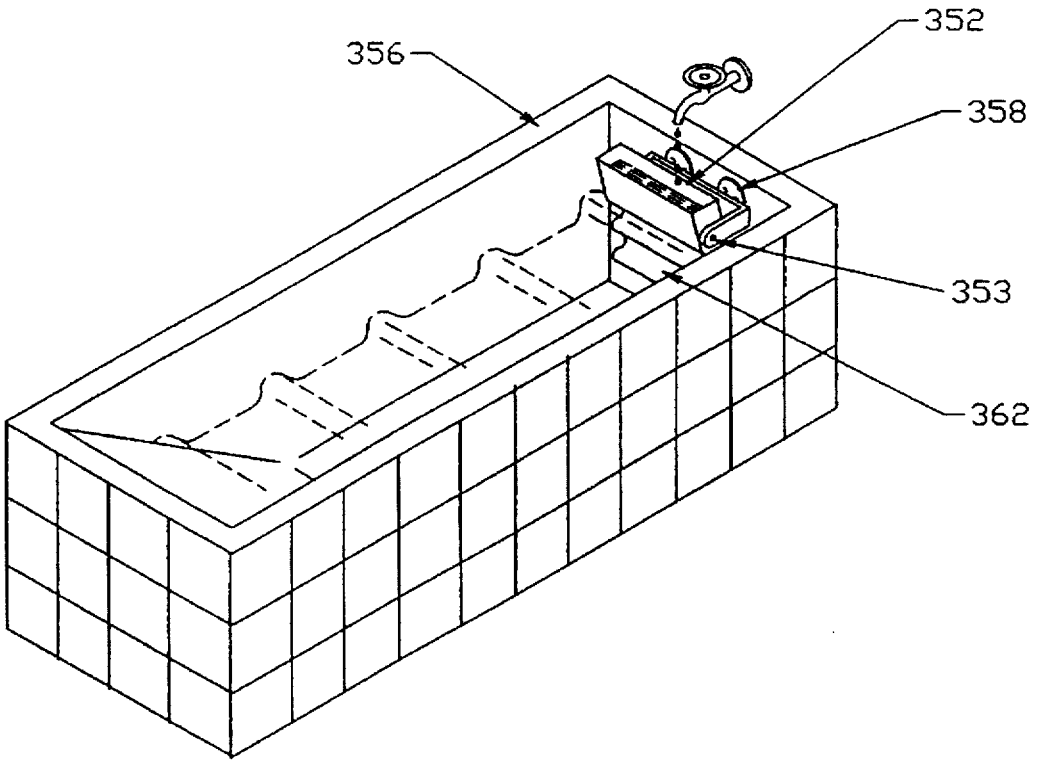
FIGS. 13A and 13B are respective perspective and side view illustrations of apparatus for creating waves in a bath tub constructed and operative in accordance with a preferred embodiment of the present invention.
Figure 13B:
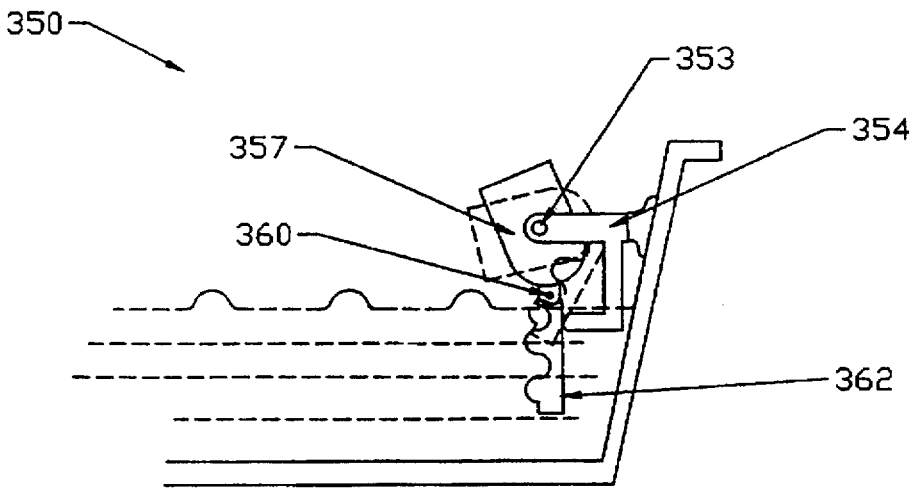

Reference is now made to FIGS. 13A and 13B which illustrate apparatus 350 for creating waves in a bath tub constructed and operative in accordance with a preferred embodiment of the present invention. Apparatus 350 comprises a turbine like apparatus 352 which pivots about a pivot 353 attached to a housing 354. The housing 354 may be attached to a bath tub 356 by means of mounting hardware 358, which may comprise suction devices.

The turbine like apparatus 352 is pivoted about the pivot 353 in such a way that the empty turbine 352 is substantially in an upright position. On substantially filling the turbine 352 with fluid, the center of gravity of the turbine 352 is sufficiently raised above the pivot 353 such that the turbine like apparatus 352 overturns, thereby emptying fluid therefrom into the bath tub 356.

The turbine like apparatus 352 comprises a counterweight 357 located at a base thereof. The counterweight 357 is operative to return the turbine 352 to a substantially upright position when sufficient fluid has been poured from the turbine 352 so as to lower the center of gravity.

The turbine like apparatus 352 preferably comprises a hinge 360 and at least one plate 362 attached to the hinge 360. The at least one plate 362 is at least partially submerged in the fluid of the bath tub 356.

In operation, fluid is introduced into the turbine 352. After a sufficient amount of fluid accumulates in the turbine 352, the center of gravity is raised and the turbine 352 overturns, thereby raising the at least one plate 362 in direction of arrow 370.

After sufficient fluid has been emptied from the turbine 352, the center of gravity is lowered such that the counterweight 357 returns the turbine 352 and the at least one plate 362 to a substantially upright position in direction of arrow 372. In the upright position, the turbine 352 may be refilled with fluid.

Thus, as the turbine like apparatus 352 is filled and emptied with fluid, the at least one plate 362 describes a periodic motion as indicated by arrows 370 and 372. This periodic motion develops a wave like movement of the fluid in the bath tub 356. Additional waves are caused by the action of the fluid spilling from the turbine like apparatus 352 into the fluid of the bath tub 356.

It is appreciated that various features of the invention which are, for clarity, described in the contexts of separate embodiments may also be provided in combination in a single embodiment. Conversely, various features of the invention which are, for brevity, described in the context of a single embodiment may also be provided separately or in any suitable subcombination.

It will be appreciated by persons skilled in the art that the present invention is not limited to what has been particularly shown and described above. Rather the scope of the present invention is defined only by the claims which follow:

We claim:

1. A shower head comprising a housing, a turbine and a fluid exit body in operative engagement therewith, such that a fluid flow through said turbine causes rotation thereof and periodic motion of said fluid exit body, said turbine being rotatable about a first axis, said fluid exit body having a central axis and being supported by said housing, in tilted position, in which said central axis is tilted at an angle relative to said first axis, and means drivingly connecting said turbine to said fluid exit body to produce rotation of said fluid exit body around said first axis while simultaneously causing said fluid exit body to undergo an oscillating, rocking movement in said housing in said tilted position.

2. Apparatus according to claim 1 and wherein said fluid exit body comprises a spray head.

3. Apparatus according to claim 1 and wherein said fluid exit body comprises a massage head.

4. Apparatus according to claim 1 and wherein said turbine has an adjustable aperture such that a quantity of said fluid flow through said turbine is controllable by adjusting said adjustable aperture, thereby permitting control of speed of said periodic motion of said fluid exit body.

5. Apparatus according to claim 1 wherein said first axis is coincident with a central axis of said shower head, said central axis of said fluid exit body being displaced with respect to said central axis of said shower head.

6. Apparatus according to claim 1 wherein said means drivingly connecting said turbine to said fluid exit body comprises a drive element situated eccentrically with respect to the axis of said turbine and operative to transfer rotation of said turbine to said fluid exit body.

7. Apparatus according to claim 1, wherein said means drivingly connecting said turbine to said fluid exit body comprises gear apparatus in rotatable engagement with said turbine and said fluid exit body, said gear apparatus being operable to reduce rotational speed of said fluid exit body with respect to rotational speed of said turbine.

8. Apparatus according to claim 1 and wherein said fluid exit body has a plurality of holes eccentrically located with respect to a central axis of said shower head.

9. Apparatus according to claim 1 and wherein said fluid exit body has a plurality of holes having different diameters.

10. Apparatus according to claim 1 and also comprising a braking device operable to substantially stop said periodic motion of said fluid exit body.

11. Apparatus according to claim 1 and wherein said turbine comprises a first blade assembly, comprising at least one blade and an exit port, and a second blade assembly, comprising at least one blade and an inlet port, such that said inlet port and said exit port may be aligned with each other upon suitable rotation of said first and said second blade assemblies with respect to each other, and wherein said flow of fluid impinges upon said first blade assembly and causes rotation thereof, and wherein said flow of fluid impinges upon said second blade assembly and causes rotation thereof only when said inlet and said exit ports are aligned with each other.

12. Apparatus according to claim 1 and further comprising attachment apparatus for assembly of a plurality of said shower heads, said attachment apparatus comprising a plurality of tubes, at least one of said tubes being adjustable in length.

13. Apparatus according to claim 1 and also comprising an elongate tube comprising at least one fluid exit body, said turbine being operative to rotate said fluid exit body alternatively clockwise and counterclockwise about a central axis of said elongate tube.

14. Apparatus according to claim 1 and wherein said fluid exit body is at least partially submerged in a fluid and is operative to move periodically, thereby creating waves in said fluid.

15. Apparatus according to claim 14 and wherein said turbine comprises a hinge and at least one plate attached to said hinge, wherein rotation of said turbine causes an oscillation of said at least one plate, thereby creating waves in said fluid.

16. Apparatus as claimed in claim 1, wherein said means which drivingly connects the turbine to said fluid exit body includes a connection which imparts rotation to said fluid exit body eccentrically with respect to said central axis of the fluid exit body.

17. Apparatus according to claim 1, wherein said housing supports said fluid exit body by means of a spherical joint.

18. Apparatus as claimed in claim 1, wherein said fluid exit body rotates around said first axis with an orbital movement.

19. Apparatus as claimed in claim 1, wherein said means which drivingly connects the turbine to said fluid exit body includes a ball joint connection between said turbine and said fluid exit body.

20. A method for applying moving fluid on a user's body by using a shower head comprising a housing, a turbine and a fluid exit body, said fluid exit body comprising a face having a plurality of holes, wherein said fluid causes said turbine to rotate and said turbine causes said fluid exit body to move in a periodic motion about a first axis and a second axis simultaneously such that said face changes its position spatially during said periodic motion, and transferring the rotation of said turbine into the periodic motion of said fluid exit body through a drive element situated eccentrically with respect to a central axis of said turbine and wherein said first axis comprises a central axis of said shower head and said second axis comprises a central axis of said fluid exit body, said central axis of said fluid exit body being tilted with respect to said central axis of said shower head thereby producing rocking movement of said fluid exit body as it rotates around said first axis.

21. A method according to claim 20 and further comprising controlling a quantity of said fluid flow through said turbine by an adjustable aperture, thereby controlling speed of said periodic motion of said fluid exit body.

22. A method according to claim 20 and comprising reducing rotational speed of said fluid exit body with respect to rotational speed of said turbine.

23. A method according to claim 20 and further comprising using a plurality of said shower heads to cause a periodic flow of fluid.

24. A method according to claim 20 and wherein said fluid exit body is at least partially submerged in a fluid and moves periodically therein, thereby creating waves in said fluid.

25. A method according to claim 24 and wherein said turbine comprises at least one plate attached to a hinge, wherein rotating said turbine causes an oscillation of said at least one plate, thereby creating waves in said fluid.

26. A method according to claim 20 and wherein said plurality of holes in said face of said fluid exit body are eccentrically located with respect to said central axis of said shower head, thus causing said fluid to exit said shower head eccentrically.

27. A method according to claim 20 and wherein said periodic motion is characterized by a period from one half to five seconds per cycle.

* * * * *